US008430761B2

(12) United States Patent
Fedorochko et al.

(10) Patent No.: US 8,430,761 B2
(45) Date of Patent: Apr. 30, 2013

(54) GOLF CLUB HEAD WEAR INDICATOR

(75) Inventors: Gary D. Fedorochko, Springfield, VA (US); William F. Rauchholz, Portland, OR (US); Chia-Chyi Cheng, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 580 days.

(21) Appl. No.: 12/566,228

(22) Filed: Sep. 24, 2009

(65) Prior Publication Data

US 2011/0070963 A1 Mar. 24, 2011

(51) Int. Cl.
*A63B 57/00* (2006.01)
*A63B 53/04* (2006.01)

(52) U.S. Cl.
USPC ..... 473/219; 473/332; 473/342; 473/349

(58) Field of Classification Search ..... 473/324–350
See application file for complete search history.

(56) References Cited

U.S. PATENT DOCUMENTS

| | | | | |
|---|---|---|---|---|
| 4,802,255 | A | 2/1989 | Breuer et al. | |
| 5,299,807 | A * | 4/1994 | Hutin | 473/329 |
| 5,674,132 | A * | 10/1997 | Fisher | 473/290 |
| 5,711,721 | A | 1/1998 | Johnson et al. | |
| 5,766,093 | A * | 6/1998 | Rohrer | 473/329 |
| 5,807,190 | A | 9/1998 | Krumme et al. | |
| 5,921,871 | A * | 7/1999 | Fisher | 473/329 |
| 5,924,939 | A * | 7/1999 | Grace et al. | 473/324 |
| 5,944,619 | A * | 8/1999 | Cameron | 473/332 |
| 6,001,030 | A * | 12/1999 | Delaney | 473/329 |
| 6,001,031 | A * | 12/1999 | San Juan | 473/340 |
| 6,033,370 | A * | 3/2000 | Reinbold et al. | 600/595 |
| 6,093,116 | A * | 7/2000 | Hettinger et al. | 473/332 |
| 6,200,229 | B1 * | 3/2001 | Grace et al. | 473/324 |
| 6,224,496 | B1 * | 5/2001 | Rowland et al. | 473/288 |
| 6,231,458 | B1 * | 5/2001 | Cameron et al. | 473/332 |
| 6,302,807 | B1 * | 10/2001 | Rohrer | 473/329 |
| 6,334,818 | B1 * | 1/2002 | Cameron et al. | 473/332 |
| 6,585,622 | B1 | 7/2003 | Shum et al. | |
| 7,014,569 | B1 * | 3/2006 | Figgers | 473/288 |
| 7,281,989 | B2 * | 10/2007 | Hou et al. | 473/326 |
| 7,353,770 | B2 | 4/2008 | Sanguinetti | |
| 7,927,230 | B2 * | 4/2011 | Solheim | 473/329 |
| 8,172,698 | B2 * | 5/2012 | Solheim | 473/329 |
| 2004/0116198 | A1 * | 6/2004 | Schudel | 473/242 |
| 2006/0166758 | A1 | 7/2006 | Roberts et al. | |
| 2008/0076598 | A1 * | 3/2008 | Lin | 473/349 |
| 2009/0233731 | A1 * | 9/2009 | Hsu et al. | 473/316 |
| 2010/0248824 | A1 * | 9/2010 | Suzuki et al. | 463/30 |

FOREIGN PATENT DOCUMENTS

| | | | |
|---|---|---|---|
| GB | 2137080 | A | 10/1984 |
| JP | 2001000593 | A * | 1/2001 |
| JP | 2005-224427 | A | 8/2005 |
| JP | 2010046498 | A * | 3/2010 |
| WO | 01-28640 | A1 | 4/2001 |

OTHER PUBLICATIONS

International Search Report and Written Opinion dated Dec. 27, 2010 in International Application No. PCT/US2010/048639.

* cited by examiner

*Primary Examiner* — Alvin Hunter
(74) *Attorney, Agent, or Firm* — Banner & Witcoff, Ltd.

(57) ABSTRACT

A golf club with a golf club head having a wear indicator is provided. The wear indicator may be located on the club head face, the hosel, the sole portion or the rear portion of the club head body. Also, multiple wear indicators may be provided on separate portions of the club head. Inserts may be used to provide a wear indicating portion. A coating may be provided to serve as a wear indicator.

22 Claims, 7 Drawing Sheets

GOLF CLUB HEAD WEAR INDICATOR

FIELD

The disclosure relates generally to ball striking devices, such as golf club heads. In particular, a golf club head is provided with a wear indicator.

BACKGROUND

The popularity of the game of golf has increased immensely in recent decades. Golfers at all skill levels seek to improve their performance, lower their golf scores, and reach that next performance "level." Most amateur golfers play with the same set of clubs for an extended period of time. For example, a set of irons may be used by a golfer for periods in excess of five and sometimes ten years.

Despite the various technological improvements, golf remains a difficult game to play at a high level. For a golf ball to reliably fly straight and in the desired direction, a golf club must meet the golf ball square (or substantially square) to the desired target path. Moreover, the golf club must meet the golf ball at or close to a desired location on the club head face (i.e., on or near a "desired" or "optimal" ball contact location) to reliably fly straight, in the desired direction, and for a desired distance. Off-center hits may tend to "twist" the club face when it contacts the ball, thereby sending the ball in the wrong direction, imparting undesired hook or slice spin, and/or robbing the shot of distance. Club face/ball contact that deviates from squared contact and/or is located away from the club's desired ball contact location, even by a relatively minor amount, also can launch the golf ball in the wrong direction, often with undesired hook or slice spin, and/or can rob the shot of distance. Inasmuch as it is difficult for a golfer to maintain a square club head, a squared contact can still result in undesirable results.

As a golf club strikes a ball time and again, golf club performance begins to deteriorate. For example, the amount and direction of spin imparted on a golf ball by the face of a golf club can gradually change over time as the face of the club changes due to repeated hits of golf balls. Nicks in the face of a club may cause undesired spin characteristics and/or loss of the ability to impart spin. Also, the grooves of a club can become shallower or uneven as the face of the club gets worn. This fact is particularly true for wedges or other clubs that are used for hitting balls out of the sand, dirt, or other abrasive terrain. Repeated hits can actually modify the face of a club itself. In addition, the hosel may lose some of its stiffness resulting in undesired energy dissipation from its increasing flexibility. The above-described gradual deterioration in club head performance over time is typically transparent to the golfer.

SUMMARY

The following presents a general summary of aspects of the disclosure in order to provide a basic understanding of the invention and its various features. This summary is not intended to limit the scope of the invention in any way, but it simply provides a general overview and context for the more detailed description that follows.

Illustrative aspects of this disclosure relate to golf club heads including wear indicators, as well as to golf clubs including such heads.

BRIEF DESCRIPTION OF THE DRAWINGS

A more complete understanding of the present invention and certain advantages thereof may be acquired by referring to the following detailed description in consideration with the accompanying drawings, in which.

Figure 1A:
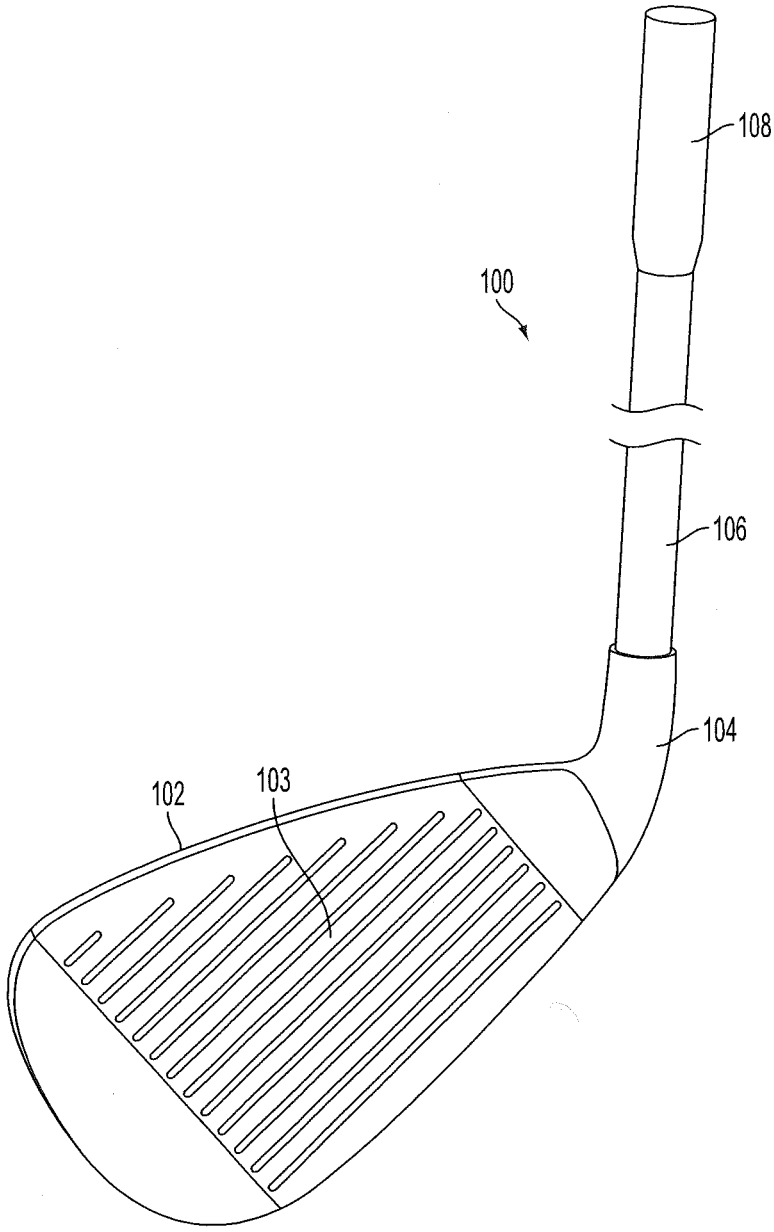
FIG. 1A provides a front view of an example iron type golf club including an iron type golf club head.

The reader is advised that the attached drawings are not necessarily drawn to scale.

DETAILED DESCRIPTION

In the following description of various example structures according to the invention, reference is made to the accompanying drawings, which form a part hereof, and in which are shown by way of illustration various example articles, including one or more golf club or golf club head structures. Additionally, it is to be understood that other specific arrangements of parts and structures may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. However, aspects of the invention may be used with any of several types of golf clubs, including iron-type clubs, wood-type golf clubs, hybrid type golf clubs, putter-type golf clubs and the like and nothing in the specification or figures should be construed to limit the invention to the specific clubs described.

In general, the disclosure relates to golf ball striking devices, such as golf club heads, and golf clubs, putter heads, putters, and the like. Such golf ball striking devices, according to at least some examples, may include a ball striking head and a ball striking surface. Some more specific aspects relate to irons and iron club heads; iron-type hybrid clubs and club heads; wood-type golf clubs and club heads, including drivers, fairway woods, wood-type hybrid clubs, and the like; putters and putter heads; and the like.

According to various aspects of this invention, the golf ball striking device may be formed of one or more of a variety of materials, such as metals (including metal alloys), ceramics, polymers, composites (including fiber-reinforced composites), and wood, and may be formed in one of a variety of configurations, without departing from the scope of the disclosure. In one illustrative embodiment, some or all components of the head, including the face and at least a portion of the body of the head, are made of metal. It is understood that the head may contain components made of several different materials, including graphite, carbon-fiber, composites and other components. Additionally, the components may be formed by various forming methods. For example, metal components (such as titanium, aluminum, titanium alloys, aluminum alloys, steels (including stainless steels), and the like) may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques.

At least some examples of golf ball striking devices relate to golf club head structures, including heads for iron-type golf clubs including long iron clubs (e.g., driving irons, zero irons through five irons, and hybrid type golf clubs), short iron clubs (e.g., six irons through pitching wedges, sand wedges, lob wedges, gap wedges, and/or other wedges), and wood-type golf clubs, such as drivers and fairway woods, and putters. Such devices may include a one-piece construction or a multiple-piece construction.

Referring to the figures and following discussion, golf clubs and golf club heads in accordance with examples of this invention are described. As discussed above, the golf club and club head structures described herein may be described in terms of iron-type golf clubs. However, the present invention is not limited to the precise arrangements disclosed herein but applies to golf clubs generally, including wood-type clubs, hybrid clubs, and the like.

Figure 1B:
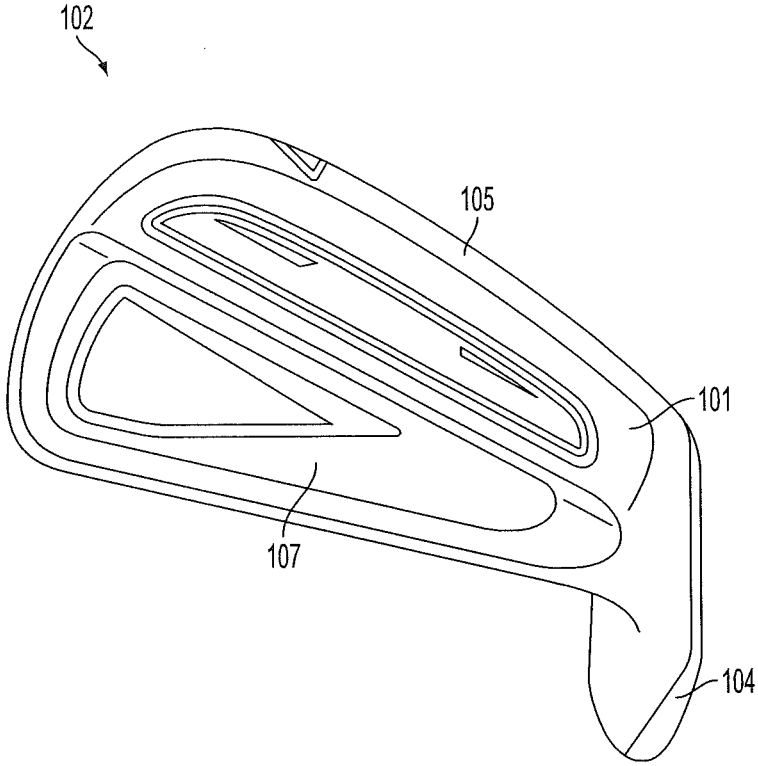
FIG. 1B provides a rear view of the iron type golf club head in FIG. 1A.

FIGS. 1A and 1B generally illustrate an example of an iron type golf club 100 and/or golf club head 102. The golf club head 102 in this example includes a body 101, a face 103 and a hosel 104. In addition to the golf club head 102, the overall golf club structure 100 includes a shaft member 106 received in and/or inserted into and/or through the hosel 104, and a grip or handle member 108 (not drawn to side) attached to the shaft member 106. The body 101 includes a sole portion 105 and a rear surface 107 opposite the face 103. In this example, the body 101 includes the face 103. It will be appreciated that golf club heads are known in which a face plate may be interchanged and coupled to a main portion of the body via adhesives, forging and other known coupling methods. For purposes of the instant disclosure, such interchangeable face plates will also be considered part of the body. Optionally, if desired, the external hosel 104 may be eliminated and the shaft member 106 may be directly inserted into and/or otherwise attached to the head member 102 (e.g., through an opening provided in the top of the club head 102, through an internal hosel member (e.g., provided within an interior chamber defined by the club head 102), etc.).

The shaft member 106 may be received in, engaged with, and/or attached to the club head 102 in any suitable or desired manner, including in conventional manners known and used in the art, without departing from the invention. As more specific examples, the shaft member 106 may be engaged with the club head 102 via a hosel member 104 and/or directly to the club head structure 102, e.g., via adhesives, cements, welding, soldering, mechanical connectors (such as threads, retaining elements, or the like, including selectively releasable mechanical connectors), etc.; through a shaft-receiving sleeve or element extending into the club head body 102; etc. The shaft member 106 also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle member 108 may be attached to, engaged with, and/or extend from the shaft member 106 in any suitable or desired manner, including in conventional manners known and used in the art, e.g., using adhesives or cements; via welding, soldering, adhesives, or the like; via mechanical connectors (such as threads, retaining elements, etc.); etc. As another example, if desired, the grip or handle member 108 may be integrally formed as a unitary, one-piece construction with the shaft member 106. Additionally, any desired grip or handle member materials may be used without departing from this invention, including, for example: rubber materials, leather materials, rubber or other materials including cord or other fabric material embedded therein, polymeric materials, cork materials (synthetic or natural), and the like.

Figure 2A:
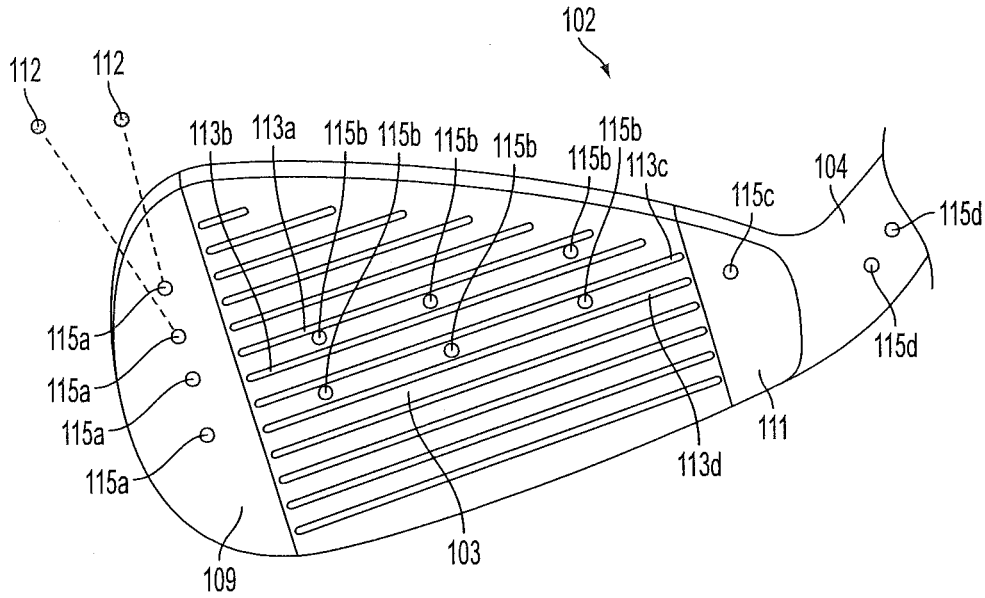
FIGS. 2A and 2B provide front and rear views, respectively, of an example iron type golf club head in accordance with illustrative aspects of the invention.

FIG. 2A illustrates an iron type golf club head 102 having cavities 115*a*, 115*b*, and 115*c*, which are configured to receive inserts and form part of the face 103, and cavities 115*d*, which are configured to receive inserts in the club head 102 and form part of the hosel 104. The cavities 115*a* are provided in a toe region 109 of club head face 103. Cavities 115*b* are provided between adjacent grooves on the club head face 103. In this example, three cavities 115*b* are provided between grooves 113*a* and 113*b* and three other cavities 115*b* are provided between grooves 113*c* and 113*d*. Also, cavity 115*c* is provided in a heel region 111 of the club head face 103. It will be appreciated that any desired number of cavities 115*a*, 115*b*, 115*c* and 115*d* may be provided from one to multiple cavities. Also, the cavity or cavities may be located at any desired position on the club head face 103 and/or hosel 104. For example, one cavity 115*c* may be provided in the heel region and no other cavities may be provided. Also, a cavity 115*d* may be provided in the hosel without other cavities on the hosel 104 or club head face 103, or with one or more other cavities.

Two illustrative inserts 112 are shown in FIG. 2A to be inserted into corresponding cavities 115*a*. Other inserts (not shown) similar to inserts 112 may be inserted into the other cavities 115*a*, 115*b*, 115*c* and 115 in the club head 102. It will be appreciated that inserts and cavities can have different shapes and sizes. The cavities 115*b* positioned between neighboring grooves can be limited in size by the space between grooves and the need to avoid structurally compromising the efficacy of the grooves.

The inserts 112 are provided to function as wear indicators to allow an individual such as a golfer to understand the degree of wear that the club has undergone. For example, the insert 112 can indicate that the face has worn sufficiently to affect club performance or that the COR (coefficient of restitution) has declined, that is that the transfer of energy from the club head 102 to a ball has fallen to a level that can effect the carry distance of a golf ball when struck by the club head. The amount of stress and pressure the club head has experienced through repeated impacts in the long run causes deterioration in club head performance. Here, the goal is to inform the golfer of the degree of deterioration though the wear indicator function.

Figure 3:
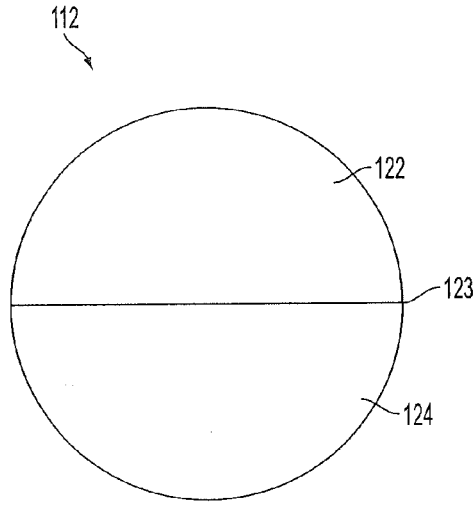
FIG. 3 provides an enlarged view of an illustrative insert for inserting into a golf club in accordance with illustrative aspects of the invention.

FIG. 3 provides an illustrative insert 112, which may be divided into two regions 122, 124. The regions 122, 124 each include a variable viscosity material that remains separated from one another in the absence of pressure. However, when the pressure on the regions of the insert 112 exceeds a threshold pressure, the materials in the respective regions 122, 124 mix together. Discussion of such materials and their use is provided in U.S. Pat. No. 7,353,770. The two different regions may have a distinguishable visual appearance from one another such that when the materials mix together, a golfer can visually discern the difference from when the materials in the regions 122, 124 were not mixed. For example, before repeated impacts with a golf ball, the boundary 123 between the regions 122, 124 blends in with the remaining portions of the club head 102 (e.g., the toe portion 109, the heel portion 111, the hosel 104). Over time from repeated impacts to the face 103 of the club head 102 the regions 122, 124 mix or bleed together, and the appearance of the insert 112 gradually changes to contrast (e.g., distinct color difference, variations in color intensity, different shades or patterns, etc.) with the face 103 and/or hosel 104 as a whole. By calibrating the degree of mixture between the two regions 122, 124, the degree of wear the club has undergone may be reflected by the level of contrast between the insert 112 and other portions of the golf club head 102. Those of ordinary skill in the art will appreciate that regions 122 and 124 may be formed of a variety of known materials that have a tendency to mix together to a great degree when under pressure or stress. In one aspect, the regions 122, 124 may be formed of a viscoplastic or non-Newtonian liquid. Viscoplastics behave like solids below a certain stress level such as a yield stress. Above that stress level, the viscoplastics behave like a viscous liquid. The regions 122 and 124 may be formed of another non-Newtonian liquid such as pseudoplastics, which are also referred to as shear thinning liquids, which experience a decreased viscosity upon an increase in shear rate. The insert 112 will in most aspects have a surface coating so that the non-Newtonian liquid is not directly exposed to the environment. The surface coating for an insert 112 on the face 103 is generally durable and able to withstand the repeated impact of the club head face 103 with a golf ball. In one example, the surface coating can be a clear polyurethane coating similar to the material utilized in golf balls. The surface coating may be applied using the methods known by one of ordinary skill in the art such as spray coating, or depositing particles of the coating on the surface and heating the surface so that the particles attach to the surface forming a coating.

When the golf club head is relatively new, regions 122 and 124 including viscoplastic materials, will generally remain distinct or separate from each other at stresses below the yield stress. As the club head 102, for example the face 103, begins to lose its resiliency or spring like characteristics, the stress on regions 122 and 124 will increase and eventually exceed the yield stress such that the regions 122 and 124 will become viscous and mix together. Since the mixing of the viscous materials causes a visual change to the insert 112, a golfer can visually recognize that the performance of the club head is deteriorating. For example, the mixing of regions 122 and 124 may cause a progressively darker region to form visually notifying the user that the club head performance has weakened and it is time to obtain a new club. The yield stress may be calibrated to the known rate of wear of a golf club.

It will be appreciation that regions 122 and 124 may be non-Newtonian viscoplastics or non-Newtonian shear-thinning materials. For example, regions 122 and 124 may be formed of Newtonian materials that have a viscosity such that the degree of mixing of the two regions 122 and 124 may be controlled as a function of pressure as is known in the art. It is also contemplated that the regions 122 and 124 may be formed of a material or materials having a viscosity that decreases as a function of time such that the viscosity of regions 122 and 124 would decrease over time and blending would occur.

In one aspect, the regions 122 and 124 may be formed of the same material having the same viscosity as a function of pressure on the regions. However, in alternative embodiments, the regions 122 and 124 may be formed of the same material, but may have different viscosities for a given pressure. Moreover, the regions 122 and 124 may be different materials altogether. For example, one of the regions 122, 124 may be a viscoplastic material, while the other is a shear-thinning material. In a further aspect, one of the regions may be formed of a variable viscosity material as described above, while the other material is formed of a solid or a material having a constant viscosity. According to this aspect, the constant viscosity material would have a porosity allowing the variable viscosity material to bleed into the constant porosity material as a function of pressure.

As discussed, the regions 122 and 124 will have a visually distinct appearance from an unmixed state and a mixed state so that a golfer can visually discern when and how much the regions have blended together. In one example, the region 122 may be clear and the region 124 may include a color dye, such as red dye. Both regions 122 and 124 may be colored with different colored dyes. In these cases, upon a change in viscosity, the two colors can mix together to form a third color as the wear indicator. In another example, both materials may be clear, but one of the regions may have colored particles suspended within the material. Thus, upon wear and the threshold yield stress on the regions 122 and 124 being exceeded, the region including the particles may bleed into the other region so that particles then enter the opposite region.

An insert in the hosel 104 showing signs of wear will indicate that the hosel is losing some stiffness. Generally speaking, wear exhibited by an insert means that performance of the club head 102 is deteriorating in one or more ways such as through nicks in the face, grooves in the face becoming shallower or losing their shape, and the surface of the face becoming uneven or deviating from the original manufactured structured.

Figure 2B:
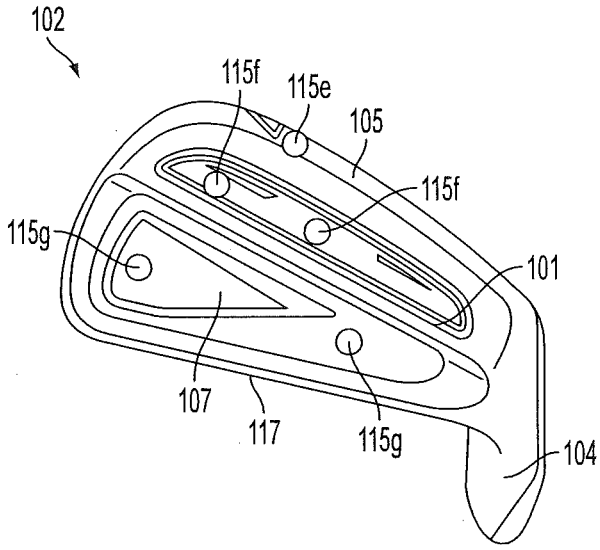

FIG. 2B shows the golf club head 102 from a rear perspective including cavities 115*e*, 115*f* and 115*g*, which are configured to receive an insert 112. Cavity 115*e* is provided on the sole portion 105 and configured to receive an insert 112. Cavities 115*f* are provided on a region of the body 101 on the rear surface (on an opposite side of the body from the face 103) in a region closer to the sole portion 105 than the top surface 117 of the club head 102. Cavities 115*g* are provided on a region of the body 101 on a rear surface closer to the top surface 117 of the club than the sole portion of the club. One cavity 115*a*, 115*b*, 115*c*, 115*d*, 115*e*, 115*f* or 115*g* or any combination of cavities may be provided for the club head 102 to allow for a golfer to detect that the golf club is wearing and the degree of wear.

In still another aspect a substantial portion of the rear surface of the upper member club head 102 may function as the wear indicator. That is, a portion of the rear surface of the body 101 behind the face 103 may be formed as one of the above described materials to provide an indication of the degree of wear a club head has undergone. According to this aspect a translucent coating such as clear polyurethane coating may be provided on the surface such that when the yield stress exceeds the threshold and mixing of materials takes place, a person may be readily able to visually discern the wear state of the club head 102. Alternatively, a clear plastic or clear polymer may function as a window to the wear indicator on the rear surface. In this instance, a color change can be readily seen through the "window".

Figure 4:
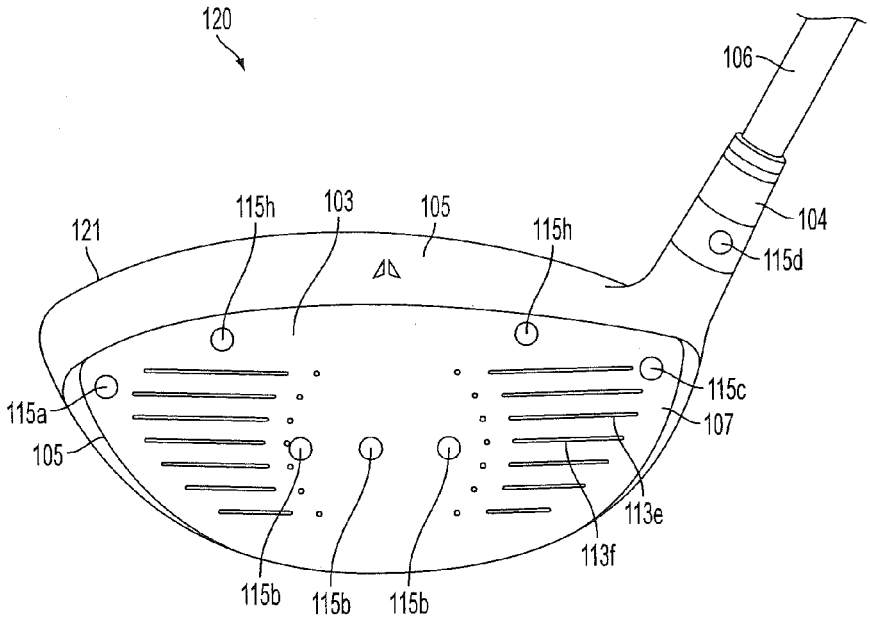
FIG. 4 provides a front view of an example wood type golf club head in accordance with illustrative aspects of the invention.

FIG. 4 illustrates a wood-type golf club 120 according to one example of this invention including a club head 121 with cavities 115*a*, 115*b*, 115*c*, 115*d* and 115*h*. For ease of reference, some of the same reference numerals have been used for the wood-type golf club 120 as for the iron type golf club 100 and the more detailed descriptions thereof have been omitted. The inserts 112 may be applied to a wood type club head 121 in the same matter as an iron type club head 102 as discussed with respect to FIG. 2A. Though not shown, the cavities 115*b* in a central portion of the face 103 may be spaced between neighboring grooves 113*e* and 113*f*. The grooves may extend through the central region. The cavities 115*h* are positioned above the grooves and the desired or optimum ball impact zone represented by the substantially circular portion in a center portion of the face 103 between the grooves of the club head 121.

Figure 5A:
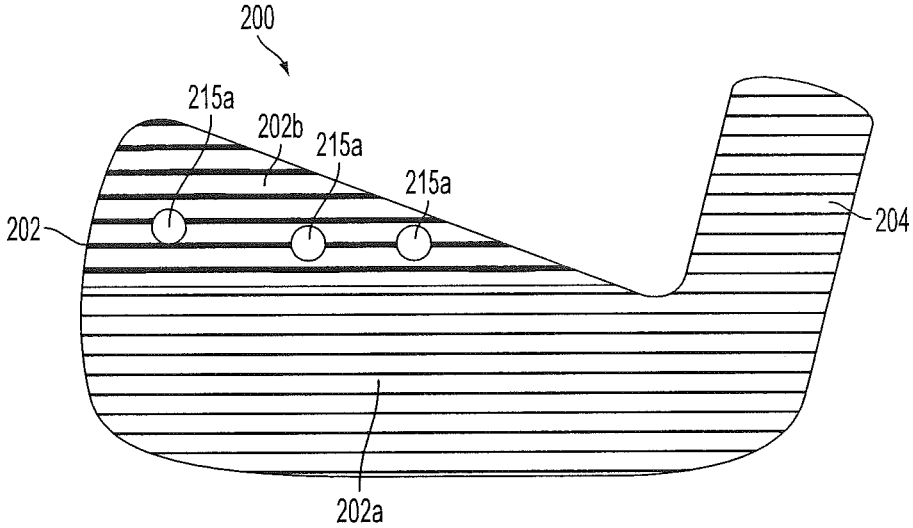
FIGS. 5A and 5B provide the front and rear views, respectively, of a two-part golf club head in accordance with illustrative aspects of the invention.

According to another aspect of an iron-type golf club head, a wear indicator may be provided in a two-part club head as described in commonly assigned, co-pending U.S. patent application Ser. No. 12/564,988 entitled "Golf Club Having Two-Part Head", which is herein incorporated by reference. FIG. 5A illustrates a front view of a two-part club head 200, which maintains the appearance of a conventional, single piece club head. That is, the face size and profile are similar or substantially similar to a conventional club head. However, the club head 200 is formed of two distinct pieces. The club head 200 shown includes a face 202 having ball striking member 202*a* which is connected to the hosel region 204, which can be connected to a shaft (not shown). The ball striking member 202*a* may be connected to the hosel region 204 via known methods of connection, including adhesives, cements, welding, mechanical fasteners, and the like. As another alternative, the ball striking member 202*a* may be integrally formed with the hosel region 204.

In addition, the club head face 202 includes an upper member 202*b* that, in some arrangements, may not form a portion of the striking face. That is, the design of the club is such that, as the club head 200 strikes the ball, contact between the club head 200 and the ball may be, and is intended to be, between the ball striking member 202*a* of the club head 200 and the golf ball and not between the upper member 202*b* and the golf ball. The upper member 202*b* may be arranged on a top surface of the ball striking member 202*a* and may be connected or bonded to the ball striking member 202*a* via known methods of attachment such as adhesives, cements, mechanical fasteners, metal joining processes such as welding, and the like.

In some examples, the ball striking member 202*a* may be formed of a high or higher density material than the upper member 202*b*. For instance, the ball striking member 202*a* may be formed of various types of metals or composite materials having a relatively high density. In some examples, the ball striking member 202*a* may be formed of carbon steel, stainless steel, or other materials used in ball striking members. The upper member 202*b* may be formed of a material less dense than that of the ball striking member 202*a*.

Figure 5B:
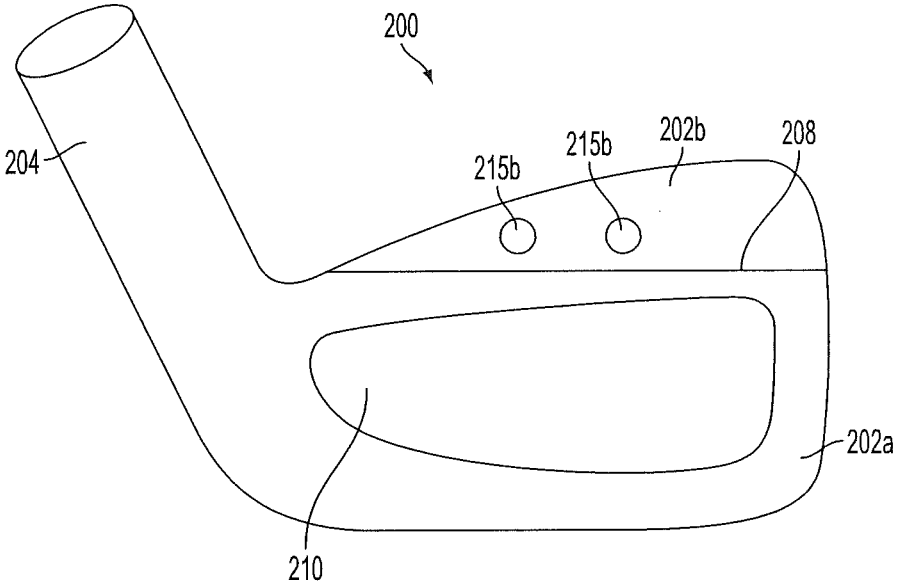

FIG. 5B is a rear view of the club head 200 of FIG. 5A. As shown, the club head 200 has the profile, size and general look of a traditional, one-piece or single material club. However, the club head 200 includes two-pieces 202*a*, 202*b*, as indicated by the separation line 208, and the two pieces are formed of two different materials. The separation line 208 is merely illustrated to indicate one possible location of separation between the ball striking member 202*a* and the upper portion 202*b*. The position of the separation may vary and the separation line 208 between the ball striking member 202*a* and the upper member 202*b* may not be visible when the club is manufactured. However, the separation line 208 is included to indicate a general area of separation between the ball striking member 202*a* and the upper member 202*b*, as shown from a rear view.

One or more cavities 215*a* may be provided in the upper member 202*b* of the club head face 202 as shown in FIG. 5A. The cavities 215*a*, like the cavities described with respect to FIG. 2A, may be of any shape and are configured to receive inserts for functioning as a wear indicator, such as inserts 112 shown and described in conjunction with FIG. 3. The cavities 215*a* may be of a number of sizes that fit on the upper member 202*b* of club head face 202. In another aspect, the cavities may be positioned on the rear surface of the upper member 215*b* for receiving the inserts 112 as shown in FIG. 5B.

In still another aspect, all or a substantial portion of a front surface of the upper member 202*b* or a rear surface of the upper member 202*b* may function as the wear indicator. According to this aspect a translucent coating may be provided on the surface such that when the yield stress exceeds the threshold and mixing of materials takes place, a person may be readily able to visually discern the wear state of the club head 200.

Figure 6:
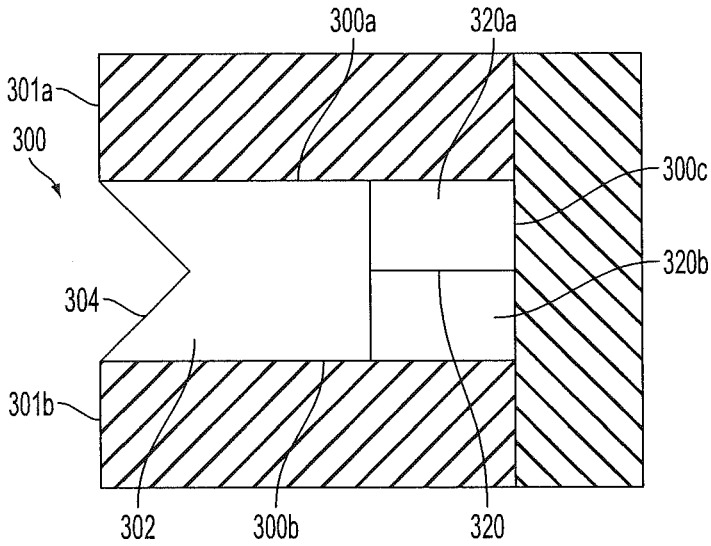
FIG. 6 is an enlarged view of an individual groove configuration in accordance with illustrative aspects of the invention.

In another aspect, a wear indicator may be provided in a groove of a golf club head such as in groove 113*a*, 113*b*, 113*c* and/or 113*d* shown in FIG. 2A. The wear indicator in the groove may be provided in one or more grooves and alone, or in combination, with any of the other wear indicators described in connection with FIGS. 2A, 2B, 5A and 5B. FIG. 6 illustrates an enlarged view of a groove 300 (e.g., groove 113*a*) between face portions 301*a* and 301*b*. The groove 300 may be formed in any suitable golf club or club face, similar to the arrangement described above, and is generally shown in an enlarged view to illustrate details of the groove 300 and groove insert 302. The groove 300 may have a generally square or rectangular cross section and includes side walls 300*a* and 300*b* and rear wall 300*c*. The groove 300 may include a groove insert 302 having a v-shaped end 304 that forms a v-shaped groove. In addition, the groove 300 may include a compressible support 320 including regions 320*a* and 320*b*, which serve as a wear indicator, arranged between the groove insert 302 and the rear wall 300*c* of the groove 300. The groove insert 302 may abut the compressible support 320. An illustrative groove structure is described in commonly assigned, copending U.S. patent application Ser. No. 12/469,831 entitled "Golf Club With Golf Club Head Having Compressible V-Shaped Grooves".

In the arrangement shown, the side walls 300*a* and 300*b* and rear wall 300*c* of the groove 300 may be formed of a dense material, such as metals, composites, etc. as described above. The groove insert 302 may be formed of a softer metal, polymer, thermal plastic, and the like. In some arrangements, the groove insert 302 may be formed of the same material as the groove 300. That is, both the groove insert 302 and groove 300 may be formed of a dense metal. The compressible support 320 may, in some arrangements, be formed of a polymer, thermal plastic, or other similar material that is configured to compress when the club face strikes the ball. More specifically, the regions 320*a* and 320*b* of compressible support 320 behave similarly to the regions 122 and 124 discussed in connection with FIG. 3. That is, the regions 320*a* and 320*b* may each include a variable viscosity material which remains separated from one another in the absence of pressure. However, when the pressure on the regions 320*a* and 320*b* exceeds a threshold pressure, the materials in the respective regions mix together. As the groove insert 302 experiences repeated contact with a golf ball, more pressure will be applied to the groove insert 302 by a ball when struck, which will then be applied to the compressible support 320. It will be appreciated that each of the above aspects of the regions 122 and 124 described in FIG. 3 may be applied to the regions 320*a* and 320*b* of the compressible support 320.

The groove insert 302 may be made of a translucent material or some other material which allows a golfer to visually discern the degree of mixing that has occurred in regions 320*a* and 320*b*. As such, the golfer will be able to visually discern the degree of wear that the golf club head has experienced.

Other ways of using the inserts described above to provide a wear indicator may be possible without departing from this invention. For example, the inserts may include an ink or dye material under pressure. In such a system, excessive wear may result in puncturing or wearing through an exterior surface of the insert such that the ink or dye material is forced outward and stains the club head face and/or the ball. As another example, the inserts may include a "whistle" type feature or other sound producing structure that will provide an audible response when excessive wear has occurred. For example, the insert could be pressurized, as described above, and equipped with a whistle structure at the outlet. In such as system, when the exterior surface of the insert is worn away or punctured, the pressurized gas within the insert will escape from the insert via the whistle opening provided at the outlet, thereby causing an audible whistle. As another example, the pressurized gas could cause an audible "pop" when the exterior surface of the insert is worn away. As yet another example, a whistle structure could be provided such that once the exterior surface of the insert is worn away, the motion of the club during a swing will cause air to pass through a whistle structure thereby providing an audible response. Other ways of providing an audible response when excessive wear is experienced may be provided without departing from this invention. Moreover, the various alternatives described above also may be used in combination with the various visual wear indicators also described above.

Figure 7:
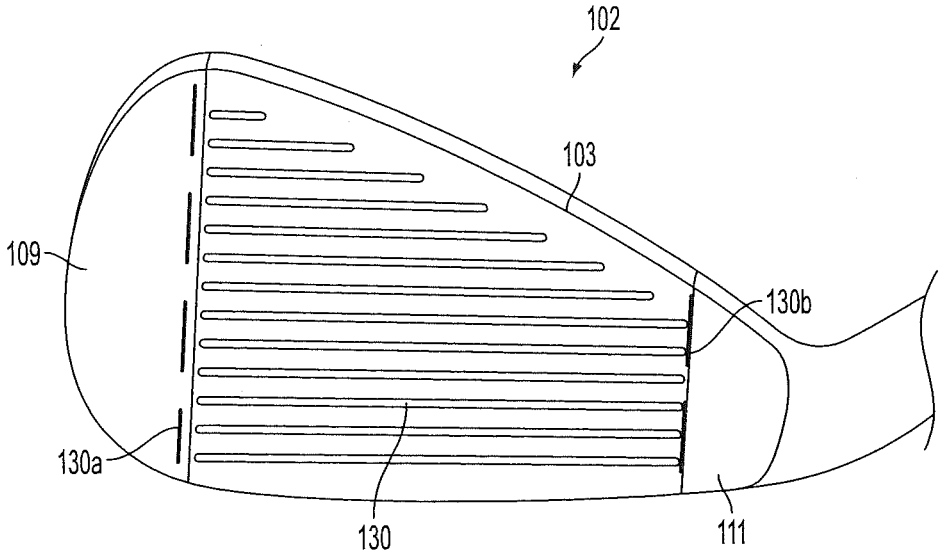
FIG. 7 illustrates another example golf club head in accordance with illustrative aspects of this invention.

According to another aspect of the invention, a wear indicator may be realized by providing coatings on a club head face. FIG. 7 provides an illustrative iron type golf club head 102 according to certain aspects. For ease of reference, some of the same reference numerals have been used for the iron type golf club head 102 in FIG. 7 as for the iron type golf club 100 and iron type golf club head 102 with reference to previous figures including FIG. 2A and the more detailed descriptions thereof have been omitted. The face 103 is divided into a toe region 109, a central region 130 and a heel region 111. The central region corresponds to the area depicted in FIG. 7, which is between the toe area 109 and heel area 111 and bounded by the edges 130*a* and 130*b*. The edges 130*a* and 130*b* are provided in FIG. 7 for illustrative purposes, and may or may not be visible. The central region includes the desired or optimal ball impact location, which generally corresponds to the desired location that the ball makes contact with the face 103 to provide the best results. During manufacturing one or more coatings may be applied to the face 103 including the central region 130. The outer surface of the face 103 includes a layer of coating. In one aspect, an underlayer is immediately below the layer of coating on the face 103. As the face 103 repeatedly strikes a golf ball, the layer of coating will begin deteriorating, such as by cracking, chipping, abrading, or peeling off, exposing the underlayer. The underlayer is set to be visually discernible from the layer of coating so that a golfer can detect when the underlayer has become exposed and how much of the layer of coating has worn away to reflect the degree of deterioration of the club head. That is, the underlayer and layer of coating on the surface may be of different colors, shades, patterns and may otherwise vary in color intensity to allow a golfer to readily detect the condition of the club head face 103. In one aspect, the outer coating may be a ceramic or polymer and the underlayer may be a thin colored layer of nylon or colored-metal such as titanium or other metals known to be used for the face of a golf club head. It will be appreciated that any portion of the face in the central region 130, toe region 109 and/or heel region 111 may include an underlayer and a layer of coating on the underlayer.

As some additional examples, if desired, the outer coating may be a metal or metal alloy and the under layer also may be a metal or metal alloy. The two layers may be engaged with one another in any desired manner, such as by adhesives or cements; by electroplating; by mechanical connectors; by nano-coating techniques; etc. In some examples the outer layer may be made of steel or titanium based materials while the underlayer is made from a different colored metal or metal alloy, such as a copper or bronze based materials. As another example, if desired, the underlayer may be painted a different color from the outer layer such that the painted surface is exposed when the outer layer is worn away.

Figure 8A:
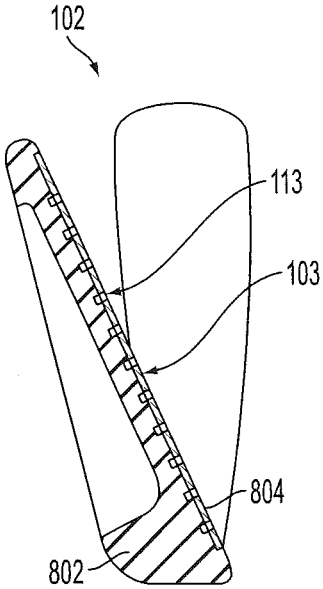
FIGS. 8A and 8B illustrate cross sectional views of an example golf club head in accordance with illustrative aspects of this invention.
Figure 8B:
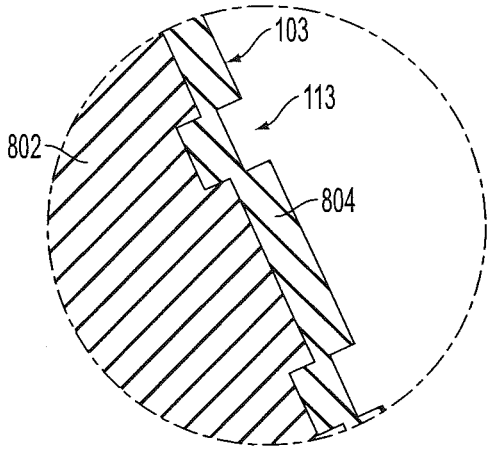

FIGS. 8A and 8B illustrate cross sectional views of a golf club head 102 including a face member 103 having a double metal layer. The face member 103 includes grooves 113 formed therein. In this example structure 102, the underlayer metal 802 forms the base material of the club head 102, including a portion of the grooves, while the exterior or outer layer 804 is formed on the under layer 802. As noted above, the underlay metal material 802 and the outer layer metal material 804 may be colored differently from one another. With use, the outer layer metal material 804 will begin to wear away, particularly with repeated contact of the club head 102 with sand, dirt, stones, or other materials, and/or with repeated contact of a ball with sand, dirt, stones, or other materials between the club head 102 and the ball. When sufficient wear occurs, the outer layer 804 will be worn away (in some instances, particularly near the grooves 113) thereby exposing underlayer 802, which can be discerned by the user due to the color change. This color change may be used as a signal to the user that the club head 102 is sufficiently worn and should be replaced.

Alternatively, if desired, the outer layer 804 may form the bulk of the club head structure 102 and the underlayer 802 may be a thin layer of differently color material provided, for example, within a recess defined behind at least some portion of the ball striking face 103. As yet some additional examples, if desired, the underlayer 802 need not form any portion of the club head grooves (if any). The underlayer 802 may be provided behind any desired area or portion of the club head face 103 without departing from this invention.

Multi-layered structures like that shown in FIGS. 8A and 8B also may be used in structures in which at least one of the layers is a non-metal material, such as a polymeric material. Examples of suitable polymeric materials include, but are not limited to: PEBAX® (polyether-block co-polyamide polymers available from Atofina Corporation of Puteaux, France), thermoplastic polymers, thermosetting polymers, etc.

In still another aspect, a colored region may extend across the bottom half of the central region 130. In this example, the colored region may provide an initial color intensity or color that is visually discernible to a golfer while the color intensity of the toe region 109, heel region 111 and other portions of the central region 130 contrasts from the colored region. In response to wear on the face 103 of the club head 102, the initial color intensity in the portion of central region 130 gradually changes and signals to the user that the club head performance is deteriorating (e.g., changing to the same color as the toe region 109 or heel region 111). The colored region can be provided, for example, by a ring dyeing process in which the portion of the face 103 contacts with a dye for a time sufficient to allow dye to accumulate or adhere on the surface. The amount of dye applied to the surface can be calibrated in accordance with how think a layer is desired. That is, the degree of dye penetration and the degree of dye fastness of a selected surface portion is coordinated with the wear characteristics of the club head 102 so that changes in color intensity provide a reliable indication of deterioration due to wear. Illustrative dyes include food dyes and certified food colorants. The dye process and materials, which may be implemented, are described in U.S. Pat. No. 4,802,255 entitled "Novel Brush Filaments", which is herein incorporated by reference.

It will be appreciated that any portion of the face in the central region 130, toe region 109 and/or heel region 111 may serve as a colored region. Also, different dyes may be used in different regions to more accurately reflect the wear and use associated that particular region. For example, the heel region 111, toe region 109 and central region 111 may experience different expect levels of wear. As such, the wear characteristics can be calibrated on a region by region basis should more than one colored region be provided.

As noted above, aspects of this invention may be practiced with any desired type of golf club head without departing from this invention. Nonetheless, aspects of this invention may be particularly useful for golf clubs intended to hit the ball from the ground, such as from sand, dirt, grass, etc. As some more specific examples, aspects of this invention may be practiced with iron type golf clubs having a loft angle of at least 40°, and in some more specific examples, for clubs having a loft angle in the range of 44° to 68° or even 48° to 64°.

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A golf club head comprising:

a face configured for striking a ball, wherein the face defines a cavity; and a wear indicator insert located in the cavity, the wear indicator insert having first and second regions that share a common border, wherein material in the first region mixes with material of the second region in response to a pressure exceeding a threshold pressure or a yield stress being exceeded, and wherein a mixture of the materials in the first and second regions is visually discernible from the individual materials in the first and second regions.

2. The golf club head according to claim 1, wherein the insert is located in a toe portion of the face.

3. The golf club head according to claim 1, wherein the insert is located in a heel portion of the face.

4. The golf club head according to claim 1, wherein the insert is located in a portion of the face between a toe portion and a heel portion of the face.

5. The golf club head according to claim 4, wherein the face includes a plurality of grooves extending across a central region of the face, the insert being located between neighboring grooves.

6. The golf club head according to claim 1, wherein the material of the first region is a viscoplastic.

7. The golf club head according to claim 6, wherein the material of the second region is a shear thinning liquid or a viscoplastic.

8. The golf club head according to claim 6, wherein the material of the second region has a constant viscosity.

9. A golf club head comprising:

a face configured for striking a ball, wherein the face includes a plurality of grooves extending across a central region of the face; and a wear indicator insert located in a first groove of the plurality of grooves, the wear indicator insert having first and second regions that share a common border, wherein material in the first region mixes with material of the second region in response to a pressure exceeding a threshold pressure or a yield stress being exceeded, wherein a mixture of the materials in the first and second regions is visually discernible from the individual materials in the first and second regions, and wherein the wear indicator insert is provided in the first groove as a part of a compressible support.

10. The golf club head according to claim 9, wherein at least the first groove includes a groove insert, which serves as an outer surface of the first groove, the groove insert abutting the compressible support.

11. The golf club head according to claim 10, wherein the groove insert is translucent.

12. A golf club, comprising:

a golf club head including a face configured for striking a ball, wherein the face defines a cavity;

a wear indicator insert located in the cavity, the wear indicator insert having first and second regions that share a common border, wherein material in the first region mixes with material of the second region in response to a pressure exceeding a threshold pressure or a yield stress being exceeded, and wherein a mixture of the materials in the first and second regions is visually discernible from the individual materials in the first and second regions; and a shaft engaged with the golf club head.

13. The golf club according to claim 12, wherein the insert is located in a toe portion of the face.

14. The golf club according to claim 12, wherein the insert is located in a heel portion of the face.

15. The golf club according to claim 12, wherein the insert is located in a portion of the face between a toe portion and a heel portion of the face.

16. The golf club according to claim 15, wherein the face includes a plurality of grooves extending across a central region of the face, the insert being located between neighboring grooves.

17. The golf club according to claim 12, wherein the material of the first region is a viscoplastic.

18. The golf club according to claim 17, wherein the material of the second region is a shear thinning liquid or a viscoplastic.

19. The golf club according to claim 17, wherein the material of the second region has a constant viscosity.

20. A golf club, comprising:

a golf club head including a face configured for striking a ball, wherein the face includes a plurality of grooves extending across a central region of the face;

a wear indicator insert located in a first groove of the plurality of grooves, the wear indicator insert having first and second regions that share a common border, wherein material in the first region mixes with material of the second region in response to a pressure exceeding a threshold pressure or a yield stress being exceeded, wherein a mixture of the materials in the first and second regions is visually discernible from the individual materials in the first and second regions, and wherein the wear indicator insert is provided in the first groove as a part of a compressible support; and a shaft engaged with the golf club head.

21. The golf club according to claim 20, wherein at least the first groove includes a groove insert, which serves as an outer surface of the first groove, the groove insert abutting the compressible support.

22. The golf club according to claim 21, wherein the groove insert is translucent.

* * * * *